United States Patent [19]

Klepfer

[11] 4,330,888

[45] May 25, 1982

[54] DISPOSABLE PROTECTIVE GARMENT

[76] Inventor: Harlan A. Klepfer, 16 Meadowstream Ct., Snyder, N.Y. 14226

[21] Appl. No.: 211,899

[22] Filed: Dec. 1, 1980

Related U.S. Application Data

[63] Continuation-in-part of Ser. No. 127,583, Mar. 6, 1980, Pat. No. 4,306,316, which is a continuation-in-part of Ser. No. 103,486, Dec. 14, 1979, Pat. No. 4,288,877.

[51] Int. Cl.[3] ..... A41B 27/12

[52] U.S. Cl. ..... 2/48

[58] Field of Search ..... 2/48, 49 R, 50, 51, 2/52

[56] References Cited

U.S. PATENT DOCUMENTS

| | | | |
|---|---|---|---|
| 2,030,135 | 2/1936 | Carpenter . | |
| 2,109,583 | 3/1938 | Bennett . | |
| 2,142,194 | 1/1939 | Karfiol . | |
| 2,523,565 | 9/1950 | Gardner . | |
| 2,755,576 | 7/1956 | Golden . | |
| 3,443,288 | 5/1969 | Batchelder et al. . | |
| 3,654,059 | 4/1972 | Zisblatt . | |
| 3,871,027 | 3/1975 | Orr | 2/49 R |
| 3,875,621 | 4/1975 | Karami . | |
| 3,884,435 | 5/1975 | McMaster . | |
| 3,948,258 | 4/1976 | Karami . | |
| 4,009,784 | 3/1977 | Elias . | |
| 4,288,877 | 9/1981 | Klepfer | 2/48 |
| 4,306,316 | 12/1981 | Klepfer | 2/48 |

FOREIGN PATENT DOCUMENTS

| | | |
|---|---|---|
| 1148145 | 4/1969 | United Kingdom . |
| 1175457 | 12/1969 | United Kingdom . |

*Primary Examiner*—Doris L. Troutman

*Attorney, Agent, or Firm*—Christel, Bean & Linihan

[57] ABSTRACT

A disposable bib, napkin or apron of flexible sheet material having a neck cutout in its upper edge portion and two shoulder pieces adjacent the cutout. The upper edge portion carries a pressure-sensitive adhesive capable of releasably adhering to the clothing or body of a user. The garment is folded upon itself prior to use about a fold line approximately midway between and generally parallel to the side edges of the garment, the adhesive releasably securing the garment in folded condition and all of the adhesive being covered by the folded garment itself. The pressure-sensitive adhesive is arranged in discontinuous areas on opposite sides of the fold line with the adhesive areas offset to be out of contact with one another when the garment is folded upon itself. To prepare the garment for use, adhesive-free edge portions are pulled apart to open the garment and expose the adhesive for placement against the clothing or body of a user.

21 Claims, 10 Drawing Figures

DISPOSABLE PROTECTIVE GARMENT

CROSS REFERENCE TO RELATED APPLICATION

This application is a continuation-in-part of my pending application Ser. No. 127,583 now U.S. Pat. No. 4,306,316 filed Mar. 6, 1980 which is a continuation-in-part of my pending application Ser. No. 103,486 now U.S. Pat. No. 4,288,877 filed Dec. 14, 1979.

BACKGROUND OF THE INVENTION

This invention relates to a disposable bib, napkin or mini-apron adapted to be fastened generally to the upper portion of the wearer's clothing to protect the same.

To the hospitalized and the aged, where self feeding is important, protecting clothing during meal times is a real problem. Protective bibs or napkins having adhesive attachment means are old and are described, for example, in U.S. Pat. Nos. 2,009,831, 2,402,734, 2,523,565, 2,617,104, 2,902,734, 3,332,547, 3,416,157, 3,675,274, 3,871,027, 3,995,321 and 3,979,776, and in British Pat. Nos. 1,148,145 and 1,175,457. However, in some prior art constructions, the adhesive portions are present in relatively small areas, which can tear away from gauze-like paper, and which can leave gaps with resulting loss of protection against soiling. Others have portions which extend behind the wearer or over his shoulder. To fasten such bibs or napkins is frequently beyond the capabilities of persons having limited motor ability in their arms, wrists, or fingers, as for example, victims of rheumatoid or osteoarthritis, the blind or many nursing home residents. The present invention is self attachable by many persons as above described who would have difficulty or find use impossible with prior art articles. Only limited motion is required for attachment with the article described herein.

The present invention has great utility in nursing and retirement homes, where many of the elderly residents suffer from arthritic conditions and other afflictions resulting in impaired motor abilities. For them to be able to attach a bib to their clothing by themselves, without the aid of an attendant, would lessen the work load on the staff as well as protect clothing which would cut down laundry time and expense.

In addition to helping morale by being more self sufficient, research in the matter has shown a reluctance for the aged to have anything fastened around their necks while eating. They prefer a situation where they can function independantly and are not reduced to "children" with around the neck "child bibs".

The present invention has utility wherever a self-adhering, disposable protective garment characterized by simplicity and ease of application is needed or desirable. It would be useful, for example, on airplanes where space constraints limit the mobility of the user and the likelihood of spilling is increased.

SUMMARY OF THE INVENTION

It is the general object of this invention to provide a self-adhering disposable bib, napkin or mini-apron which is free from snaps, ties, strings and the like, which is easily attached to a wearer's clothing by oneself and does not require extensive stretching or movement of arms, wrists or fingers or eyesight for doing so, which is constructed and arranged to be its own protective cover prior to use, without need for a removable overlay or tear-off strips which can create a litter problem, and which can utilize relatively flimsy garment materials as well as materials which are relatively substantial.

Another object is to accomplish this in a construction which can be mass produced at low cost, and which is disposable as a unit after use.

The novel garment of this invention comprises a body of flexible material, such as paper, fabric or plastic, or a combination thereof, and has pressure-sensitive adhesive carried by its upper edge portion. To protect the adhesive until use, the garment is folded over upon itself in a manner covering the pressure-sensitive adhesive portions which releasably secure the garment in folded relation and are arranged to be out of contact with each other when the garment is folded upon itself. For use, the folded garment is opened, exposing the adhesive which is placed generally against the wearer's clothing or body.

The foregoing and other objects, advantages and characterizing features of this invention will become apparent from the ensuing detailed description of certain illustrative embodiments thereof taken in conjunction with the accompanying drawings wherein like reference numerals denote like parts throughout the various views.

THE DRAWINGS

DESCRIPTION OF THE ILLUSTRATED EMBODIMENTS

Figure 1:
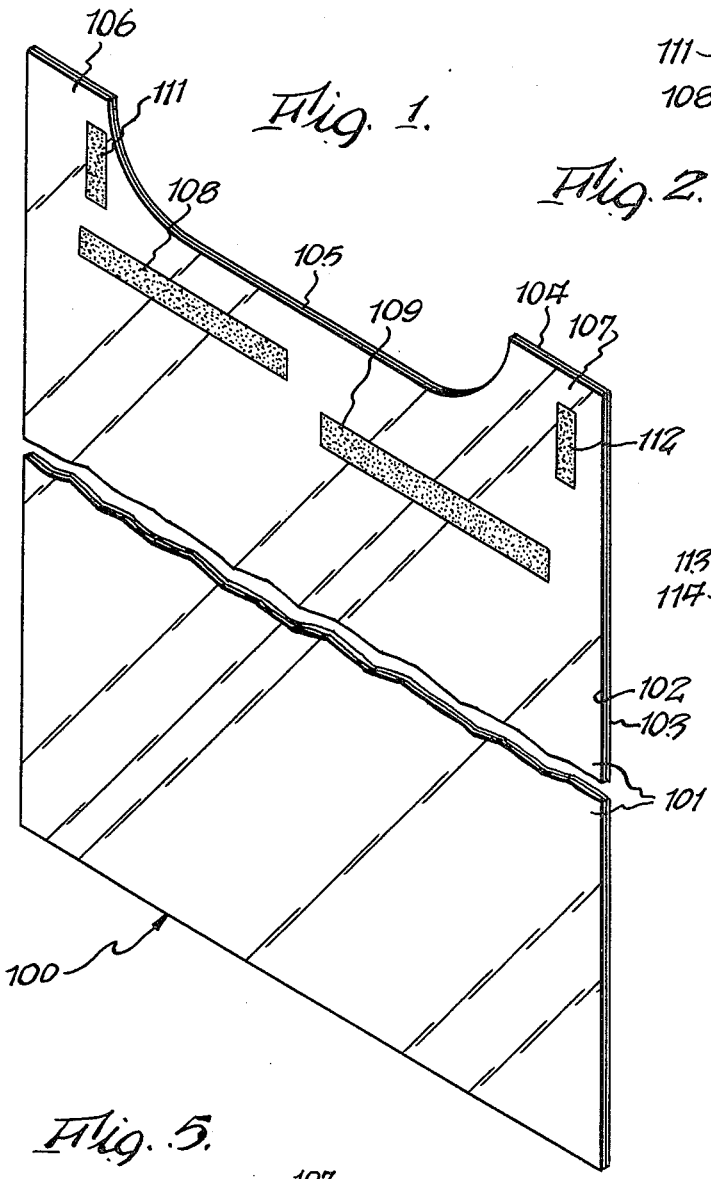
FIG. 1 is a perspective view of a protective garment of this invention, taken from the body side and showing the garment open, with the adhesive exposed, ready for use, the garment body being broken away to indicate variation in length.

Referring first to the embodiment of FIGS. 1–5, there is shown a protective garment of flexible sheet material, generally designated 100, having an elongated, generally rectangular shape although it will be appreciated that other shapes may be employed when appropriate. The garment body 101 can be made of paper stock, for example the type of multi-ply stock used in conventional paper napkins for economy and ease of disposal. However, cloth, plastic or other materials, alone or in various combinations can be used when the characteristics of such materials or combinations of materials make them advantageous or desirable for a particular purpose. In the illustrated embodiment, the body 101 is of multi-ply construction having a sheet 102 of synthetic plastic material, such as polyethylene bonded to a sheet 103 of absorbent paper stock.

The size of the garment will vary, depending upon its intended use, and particularly whether it is intended for use by children or by adults, and whether it is intended for use as a napkin, a bib or an apron, either mini or full sized. In any case, the garment will be of a size such that, when it is opened, it will cover the area to be protected. For example, when open the garment may have a length of approximately twenty-six inches and a width of thirteen inches, or it may have a length of approximately nineteen and one half inches and a width of approximately thirteen inches, both of which examples fold to an approximate six and one half by six and one half inch shape for convenient packaging and storage. It will be appreciated that these dimensions are given by way of example only.

The upper edge 104 of garment 100 has a centrally located, shallow, neck cut-out or recess portion 105 on opposite sides of which are side or shoulder portions 106, 107 adapted for attachment to the chest or front shoulder areas of the user. A discontinuous layer of pressure sensitive adhesive is carried by the upper edge portion of the garment on the body side, this being the side defined by plastic sheet 102. In the embodiment of FIGS. 1–5 the pressure sensitive adhesive is provided in separate, discrete portions or areas, two such portions being provided beneath neck recess 105 as shown at 108 and 109. Additional areas or portions of pressure sensitive adhesive are provided on the shoulder portions 106, 107 as shown at 111 and 112, respectively.

The total area of pressure sensitive adhesive provided by the portions 108, 109, 111 and 112 is sufficient to provide an adequate surface for adhesion to the user's clothing or body, such that the garment 100 will not become dislodged or tear loose from the user because of slight pulls, tugs or body movements such as might be encountered during normal use of the garment. In addition, the arrangement of the adhesive areas 108, 109, 111 and 112 is such as to avoid any significant gapping of the upper edge portion of the garment when the garment has been positioned on the user. In this way, effective protection against soiling is provided. Beyond this criterion, the total area of adhesive may be selected for greatest economy and convenience in manufacture. For example, each adhesive area 108, 109 can measure five and one-half inches by three-quarters of an inch, and each adhesive area 111, 112 can measure two and one-quarter inch by one-half inch, these dimensions being given by way of example only. The pressure sensitive adhesive can be of any suitable composition, selected to releasably adhere to the clothing or body of a user with sufficient total adhesive force to preclude accidental removal, while permitting quick and easy removal when desired, such pressure sensitive adhesive compositions being known and commercially available. It is contemplated that the adhesive layer will be substantially continuous throughout each area 108, 109, 111 and 112.

Prior to use it is important that the pressure sensitive adhesive areas 108, 109, 111 and 112 be covered and not exposed, to prevent unwanted adhesion during handling, packaging and storage. It is one of the features of this invention that the garment is self-protecting in this respect, and does not require a separate protective strip or overlay. This is accomplished by folding the garment 100 about a fold line, indicated at 113 in FIG. 2, which fold line is approximately midway between and generally parallel to the opposite side edges 114 and 115 of the garment body 101. The garment is folded about line 113 to the position shown in FIG. 3. When this is done it will be seen that adhesive areas 108, 109, 111 and 112 releasably adhere to the garment material 102, thereby releasably securing the garment in the folded condition shown in FIG. 3, and also that the folded garment material completely covers the various adhesive areas 108, 109, 111 and 112, thereby providing a self-contained protective cover for the areas of pressure-sensitive adhesive.

Figure 2:
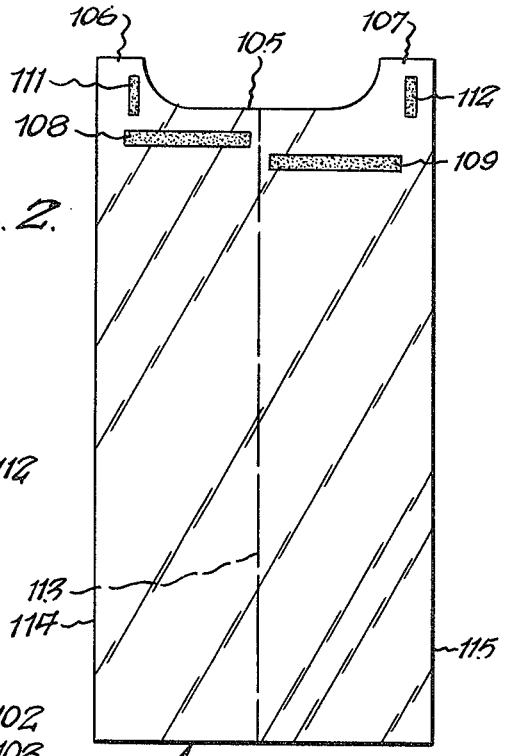
FIG. 2 is an elevational view of the body side thereof on a reduced scale, the fold line being indicated in broken lines.
Figure 3:
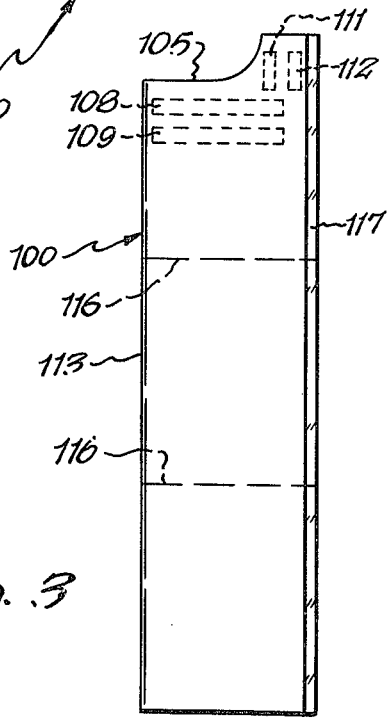
FIG. 3 is an elevational view thereof with the garment folded upon itself to protect the adhesive.

In addition, it is a particular feature of this invention that the various adhesive areas are offset, relative to one another, whereby when the garment is folded about line 113 the various adhesive areas are out of contact with one another. In the embodiment of FIGS. 1–5 it will be seen that adhesive areas 108 and 109, which are laterally elongated and extend across the major portion of the garment below neck recess cut-out 105, are offset from one another lengthwise of the garment, in the direction of fold line 113, whereby when the garment is folded to the condition of FIG. 3 the offset areas 108 and 109 do not contact each other but instead contact overlying areas of sheet material 102 in spaced apart relation lengthwise of the garment, out of contact with each other. The adhesive areas 111, 112 on shoulder portions, 106, 107 are elongated in the direction of fold line 113, and are laterally offset relative to one another and to fold line 113, whereby when the garment is folded about line 113 adhesive areas 111, 112 do not contact each other but instead contact overlying areas of sheet material 102 in laterally spaced apart relation, out of contact with one another. Thus, the adhesive areas contact only garment material and are totally out of contact with each other, as shown in FIG. 3. This arrangement of spaced, offset areas of adhesive which contact the sheet material 102 but not each other when the garment is folded about line 113 to the condition of FIG. 3 has the advantage that the folded sections are readily pulled apart and separated without tearing the material or rupturing the multi-ply construction of the garment body 101, and without significant separation of adhesive from the respective areas, even when the garment material is relatively flimsy in nature. The pressure sensitive adhesive areas offer relatively low pull apart resistance, sufficient to releasably retain the garment in position on the clothing or body of the user while facilitating separation of the folded garment halves without pulling apart the sheet material 102, 103. Obviously, the materials comprising the garment body can be relatively substantial and strong, but often soft, loosely woven, absorbent and very thin plastic materials are desirable and the adhesive arrangement of this invention facilitates the utilization of such materials.

Figure 4:
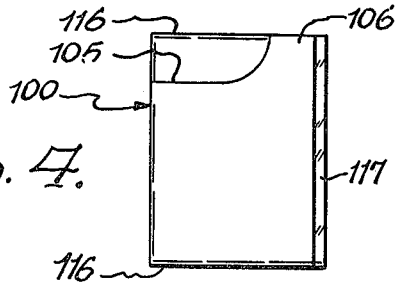
FIG. 4 is an elevational view showing the garment in its fully folded condition, ready for packaging or storage prior to use.

For purposes of storage prior to use, it is contemplated that the folded garment material in an elongated version such as shown in the drawings, will be folded again, about spaced-apart lines 116 extending at a right angle to the opposite side edges, to the compactly folded condition of FIG. 4 which illustrates the completely folded garment ready for packaging, or storage, prior to use.

Figure 5:
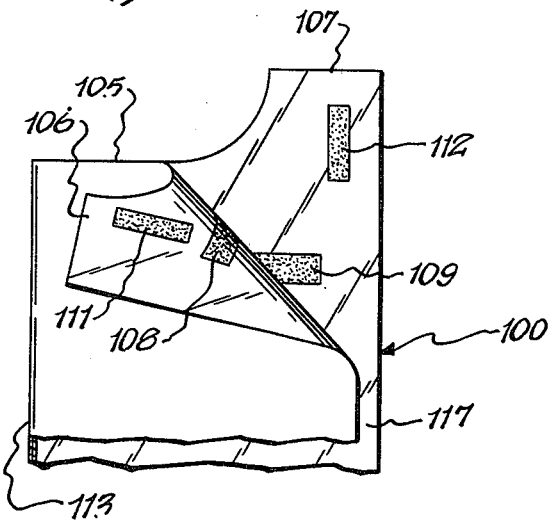
FIG. 5 is a fragmentary detail view on an enlarged scale showing how the adhesive-free upper side edge portions are pulled apart to open the garment for use.

When it is planned to use the garment, it is unfolded to the condition shown in FIG. 3. Then the upper top or side edge portions at the shoulder areas are grasped and the garment halves pulled away from one another, as indicated in FIG. 5. The upper edge (104) portions and upper side edge portions of the garment are free of adhesive, to facilitate grasping those portions to pull open the folded garment, and it will be noted that in the embodiment of FIGS. 1–5 the fold line 113 is slightly off-center, thereby leaving a projecting side edge portion 117 to additionally facilitate such opening. With the garment fully opened, as shown in FIG. 2, the adhesive areas are exposed and the garment is ready for application to the body or clothing of the wearer. The user places the neck cut-out portion 105 below the chin, for centrally positioning the garment over the chest area, the portions 106 and 107 then being in position for pressing against the body or garment of the user. The pressure sensitive adhesive in the areas 108, 109, 111 and 112 essentially seals the area across the top of the garment, except for the extreme side edge portions which do not pose a problem, the area beneath and on opposite sides of the neck cut-out 105 being substantially closed by adhesive. In this way, there is no significant gapping at the upper edge portion of the garment. Since there is no portion of the garment which is behind the neck or shoulders, the arms or hands need not be stretched and little finger dexterity is required to position the garment. In use, the length of the napkin and the ability to fasten it high on the wearer's body give protection to a large area of the wearer's clothing from below the chin down across the lap area. The lower end of the bib or napkin can be picked up to wipe the mouth when desired, without detaching the garment from the body, and whether the garment is attached high or low on the wearer's body it will not slide off accidentally, and therefore will offer continued protection to the wearers clothing. After use, the garment is easily pulled off and discarded, leaving no visible marks from the adhesive on the wearer's garments, and is readily disposable as a unit, in the manner of a conventional paper napkin.

In those cases where, for whatever reason, it is desired not to adhere the protective garment to the wearer's clothing, the adhesive-carrying upper edge portion of the garment can be folded downwardly upon itself, about a line parallel to the lines 116, the adhesive then adhering to the garment body material 102 and being covered, permitting the napkin to be used in the manner of an ordinary napkin with no adhesion whatever.

Looking now at the embodiment of FIGS. 6–10, the garment 100' differs from the garment 100 in the arrangement of the adhesive areas. Laterally elongated adhesive areas 111', 112' are provided on the shoulder portions 106, 107 and are relatively offset lengthwise of the garment, in the direction of the fold line 113'. Below the neck cut-out 105 the adhesive is provided in areas 118, 119, 120 and 121 which are spaced apart laterally across the garment and are elongated in the direction of fold line 113'.

Figure 8:
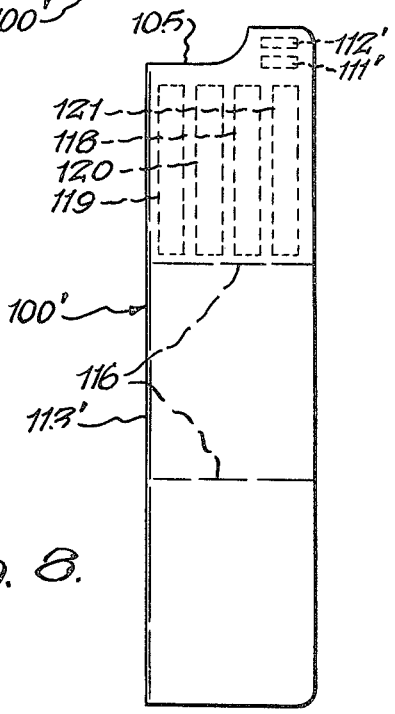
FIG. 8 is a view like that of FIG. 3, but showing the modified form of FIG. 6.
Figure 9:
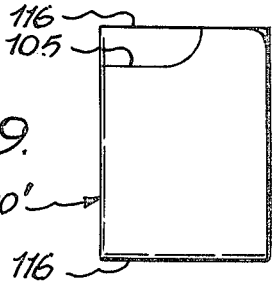
FIG. 9 is a view like that of FIG. 4, but showing the modification of FIG. 6.
Figure 10:
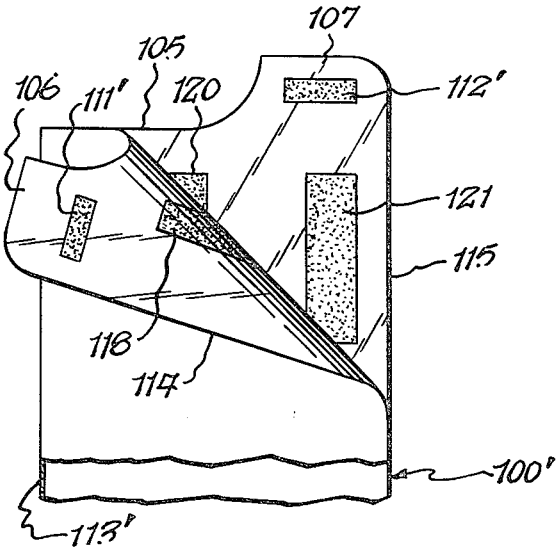
FIG. 10 is a fragmentary view, similar to that of FIG. 5 but showing the modification of FIG. 6.

In this embodiment fold line 113' is a center line, whereby when the garment is folded to the condition of FIG. 8 the opposite side edges 114, 115 coincide. The shoulder adhesive areas 111', 112' are spaced apart and offset, and so also are the adhesive areas 118–121 which are laterally offset relative to fold line 113' such that when the garment is folded about line 113' the adhesive areas 118–121 interfit, in spaced apart relation, as shown in FIG. 8. In all other respects the embodiment of FIGS. 6–10 is like that of FIGS. 1–5. When the garment 100' is folded about line 113' to the condition of FIG. 8, the adhesive areas 111', 112', 118, 119, 120 and 121 do not contact each other but contact material 102 in spaced apart relation, whereby all of the adhesive areas are covered in a manner facilitating separation in preparation for use without tearing or otherwise disrupting the garment material even when flimsy materials are used.

Figure 6:
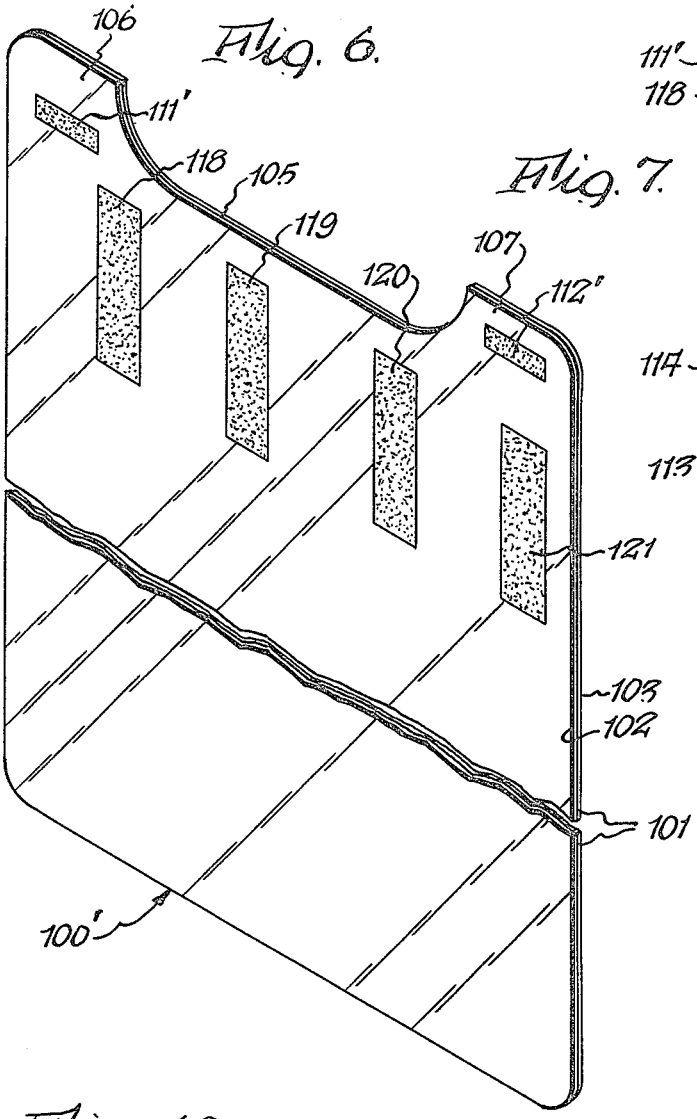
FIG. 6 is a perspective view similar to that of FIG. 1 but showing a modification; p
Figure 7:
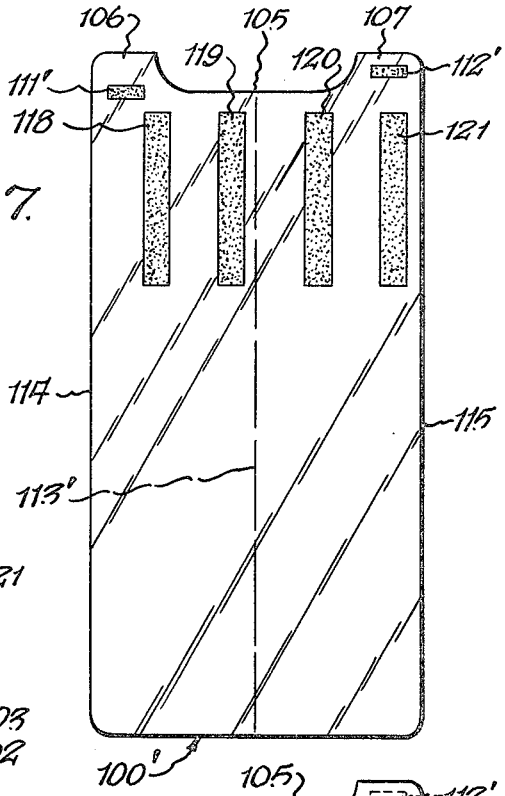
FIG. 7 is a view similar to that of FIG. 2 but showing the modification of FIG. 6.

The arrangement of FIG. 6 provides a larger total area of adhesive, and the adhesive areas are so arranged as to provide adequate adhesion to the garment or body of the user without significant gapping. For example, each area 118–121 can measure three and one-half by one inch, and each area 111', 112' can measure one and one-half by one-half inch, these dimensions being given by way of example only.

The adhesive can be applied directly to the garment material, or in the form of tapes applied to the material, in any suitable manner known to the art, and can be applied as described in my earlier applications identified above.

Having disclosed and described my invention in certain presently contemplated forms, it will be understood that this is done by the way of illustration only and that the scope of my invention is intended to be defined by the appended claims.

What is claimed is:

1. A protective garment in the form of a bib, napkin or apron comprising a body of flexible sheet material having an upper edge portion and opposite side edge portions, pressure sensitive adhesive carried by said garment and capable of releasably adhering to the clothing or body of a user, said garment having a fold line substantially parallel to and spaced from each of said opposite side edges and having the two portions thereof defined by said fold line in substantially overlying relationship, said adhesive releasably securing the adhesive-carrying portion of said garment in folded relation and with all of said adhesive covered by said folded garment, said adhesive arranged on said garment in discontinuous areas offset relative to each other whereby said areas of adhesive are out of contact with one another when said garment is folded upon itself, said garment having substantial areas without adhesive to facilitate unfolding said garment and thereby exposing said adhesive for placement against the clothing or body of a user.

2. The garment of claim 1, wherein said upper edge portion of said garment has a central neck recess portion and shoulder portions on opposite sides thereof, said adhesive arranged across said garment below said recess portion and on said shoulder portions in a pattern sufficient to releasably secure said garment to the clothing or body of a user without significant gapping of said upper edge portion.

3. The garment of claim 1, wherein said fold line is positioned approximately midway between and parallel to said opposite side edge portions, and said adhesive is arranged on opposite sides of said fold line.

4. The garment of claim 3, wherein said areas of adhesive are elongated in the direction of said fold line, and include at least two such areas of adhesive spaced apart on each side of said fold line with the adhesive areas on one side of said fold line laterally offset relative to the adhesive areas below said neck recess portion on the other side of said fold line.

5. The garment of claim 3, wherein said areas of adhesive below said upper edge portion are laterally elongated with the adhesive on one side of said fold line offset in the direction of said fold line relative to the adhesive below said upper edge portion on the opposite side of said fold line.

6. The garment of claim 2, wherein the adhesive on one of said shoulder portions is laterally offset relative to the adhesive on the other of said shoulder portions.

7. The garment of claim 2, wherein the adhesive on one of said shoulder portions is offset in the direction of said fold line relative to the adhesive on the other of said shoulder portions.

8. The garment of claim 1, wherein the upper edge of said garment is free of adhesive.

9. The garment of claim 1, wherein the opposite side edges of said garment are free of adhesive.

10. The garment of claim 1, wherein said fold line is offset relative to a line midway between said side edge portions so that one side edge of said garment extends laterally beyond the opposite side edge thereof when said garment is folded upon itself along said fold line, and the opposite side edges of said garment are free of adhesive.

11. The garment of claim 1, said flexible sheet material comprising a sheet of synthetic plastic material on one side of said garment and a sheet of absorbent paper material on the opposite side of said garment, said adhesive carried by said sheet of plastic material on said one side of said garment.

12. A disposable protective garment in the form of a bib, napkin, or apron, said garment comprising:

(a) a sheet of flexible material having an outer face, an inner face, an upper edge portion, a lower edge portion, and opposite side edge portions;

(b) at least one area of pressure sensitive adhesive positioned on said inner face adjacent said upper edge portion and capable of releasably adhering to the clothing or upper body of a user, substantial areas of said inner face being free of adhesive;

(c) a fold line dividing said garment into two portions positioned in substantially overlying relationship when said garment is folded over upon itself along said fold line;

(d) said adhesive releasably securing the adhesive-carrying area of said inner face to an area of said inner face which is free of adhesive, all of the adhesive-carrying areas of said inner face being covered by said non-adhesive-carrying areas of said inner face when said garment is folded over upon itself along said fold line.

13. The garment of claim 12 wherein said adhesive is positioned on each side of said fold line.

14. The garment of claim 12 wherein said fold line is substantially parallel to one pair of said edges of said sheet.

15. The garment of claim 14 wherein said fold line is positioned substantially midway between one pair of said edges of said sheet.

16. The garment of claim 14 wherein said fold line is offset relative to a line midway between said edge portions so that one edge of said garment extends outwardly beyond the opposite edge thereof when said garment is folded upon itself along said fold line.

17. The garment of claim 12 wherein said upper edge portion of said garment includes a recessed central neck portion and shoulder portions on each side thereof, said adhesive positioned below said recessed portion and on said shoulder portions to releasably secure said garment to the clothing or upper body of a user without significant gapping of said upper edge portion.

18. The garment of claim 17 wherein said inner face is substantially non-absorbent.

19. The garment of claim 18 wherein said inner face is a synthetic plastic material.

20. The garment of claim 18 wherein said outer face is absorbent.

21. The garment of claim 20 wherein said outer face is absorbent paper.

* * * * *